United States Patent [19]

Wollrich

[11] Patent Number: 4,816,260

[45] Date of Patent: Mar. 28, 1989

[54] PERSONAL PROTECTION DEVICE

[76] Inventor: Gary Wollrich, 15550 Buffalo St., Anchorage, Ak. 99516

[21] Appl. No.: 824,234

[22] Filed: Jan. 30, 1986

Related U.S. Application Data

[63] Continuation-in-part of Ser. No. 770,191, Aug. 28, 1985, abandoned.

[51] Int. Cl.[4] ..... A61K 9/48

[52] U.S. Cl. ..... 424/463; 424/455; 514/920

[58] Field of Search ..... 428/321.5, 325, 406, 428/905; 424/405, 408, 411, 414, 416, 417, 463, 455; 222/175; 604/306; 514/920

[56] References Cited

U.S. PATENT DOCUMENTS

| | | | |
|---|---|---|---|
| 4,428,506 | 1/1984 | Withey | 222/80 |
| 4,528,226 | 7/1985 | Sweeny | 428/40 |
| 4,529,466 | 7/1985 | Stol | 428/65 |

*Primary Examiner*—Ellis P. Robinson
*Assistant Examiner*—P. R. Schwartz
*Attorney, Agent, or Firm*—Burns, Doane, Swecker & Mathis

[57] ABSTRACT

A personal protection device having a flexible support, and a breakable capsule at a front surface of the support, which capsule contains skunk essence. Upon attack, the user bends the support to break the capsule in the direction of an assailant in order to repel the assault.

15 Claims, 1 Drawing Sheet

FIG. 1
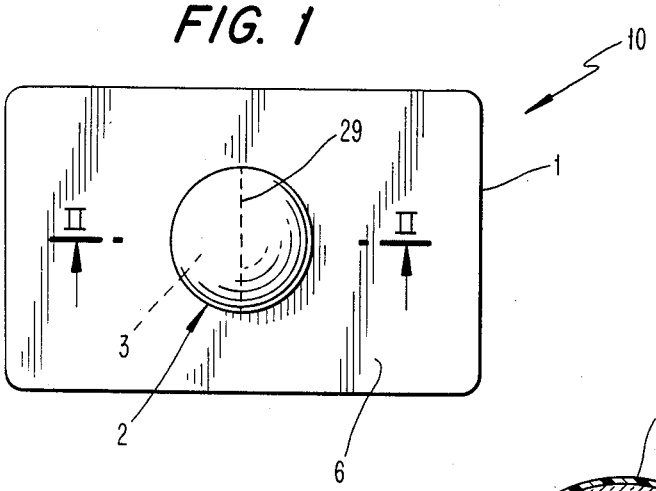
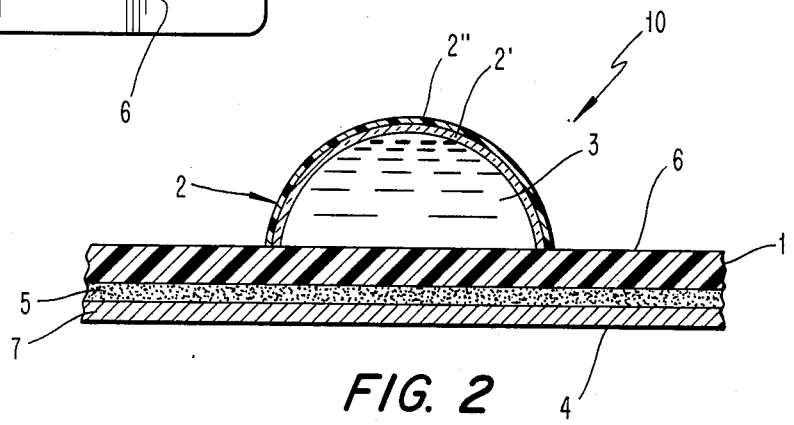
FIG. 2
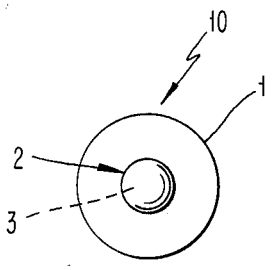
FIG. 3
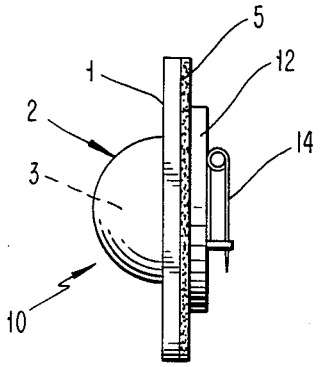
FIG. 4
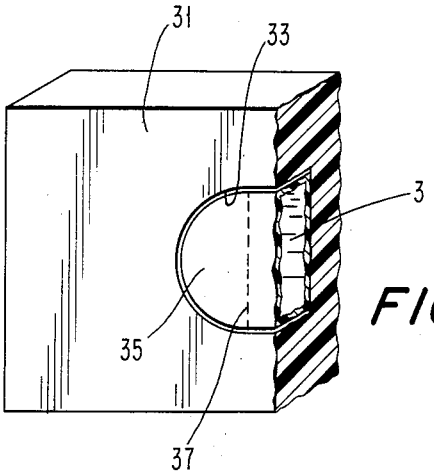
FIG. 5

PERSONAL PROTECTION DEVICE

RELATED APPLICATION

This application is a continuation-in-part of Ser. No. 770,191 filed Aug. 28, 1985 now abandoned.

BACKGROUND OF THE INVENTION

This invention relates to a personal protection device which will protect the user from attack without physically harming either the assailant or the user.

Weapons used to protect oneself from assault by either man or beast are well known and include physical weapons such as guns and knives, and chemical agents such as chloroacetophenone (sold under the trademark MACE). While these weapons repel the attack, they may physically harm both the attacker and the victim.

Prior to the present invention, there existed a need for an easy-to-use personal protection device which would not only repel an attack, but would be safe enough for all ages to use. This was especially important for a child being kidnapped or a woman afraid of being physically attacked, but until now they had no effective and safe weapon with which to defend themselves.

The main object of the present invention is to provide an easy-to-use personal protection device.

Another object of the invention is to provide a personal protection device which will not permanently harm either the attacker or the user.

Other objects, features and advantages of the present invention will become fully apparent from the following detailed description of the preferred embodiment, the appended claims and the accompanying drawings.

SUMMARY OF THE INVENTION

The present invention is a personal protection device. The device includes a flexible support and a breakable capsule at a front surface of the support, which capsule contains skunk essence.

BRIEF DESCRIPTION OF THE DRAWINGS

FIG. 1 is a view of a front surface of a first embodiment of the personal protection device of the present invention.

FIG. 2 is a cross-sectional view along the line II—II of FIG. 1, which view is magnified to better illustrate the various layers.

FIG. 3 is a view of a second embodiment of the present invention.

FIG. 4 is a view of a device according to the present invention which includes means for attaching the device to clothing.

FIG. 5 is a view of a third embodiment of the present invention.

DESCRIPTION OF THE PREFERRED EMBODIMENTS

A first embodiment of the present invention is illustrated in FIGS. 1 and 2. The personal protection device has a flexible support 1, having a front surface to which is attached a capsule 2 containing a skunk essence 3 which is readily commercially available.

With respect to support 1, any material which is flexible and impermeable to prevent skunk essence 3 from being sprayed toward a back surface, i.e., in the direction of the user, is acceptable. The material must be able to be flexed or bent into slightly arched configuration without cracking or breaking. A preferred material is a plastic, such as that used to make credit cards. The capsule 2 containing skunk essence 3 can be attached to support 1 in any convenient manner. It is preferred that the capsule 2 be a separate element preferably of plastic which is adhered to the front 6 of support 1 by, for example, heat sealing or gluing. An alternative is to laminate an envelope of plastic around a previously assembled combination of support 1 and filled capsule 2. This separate sheet of plastic or laminate is preferably perforated at the place where it contacts capsule 2 in such a manner that a fine stream of skunk essence 3 is sprayed out of the device when capsule 2 is broken by bending support 1.

Support 1 can be any suitable size and shape. A preferred embodiment is one in which support 1 is approximately the size and shape of a credit card, e.g. 5 cm×8 cm, which makes device 10 large enough to be easily handled and yet small enough to be easily carried or attached to garments. It is important that device 10 be readily bent, and thus shapes such as triangles should be avoided. However, it is important that support 1 not be too readily bent to prevent accidental release of the skunk essence 3. A preferred method of accomplishing this is to make support 1 thick enough that it cannot be accidentally bent. During an attack, it has been stated that adrenaline results in the user having three times his or her normal strength. This so-called "adrenaline factor" allows support 10 to be made thick and strong enough that it can only be bent to release the skunk essence 3 during an attack.

FIG. 3 illustrates an alternative embodiment of the present invention in which support 1 is circular. Regardless of the shape of support 1, it should be no smaller than about 3 cm, or device 10 becomes too difficult to handle in the circumstances in which it would commonly be used.

Capsule 2 containing skunk essence 3 can be made of any suitable material which does not allow the odor to permeate through it, and will not break until desired. The material of the capsule is preferably rigid such that bending or flexing of support 1 causes bending of capsule 2. The material of the capsule 2 is less flexible and has a lower mechanical bending strength than support 1 so that the bending causes breakage of capsule 2. In order to promote breakage at the desired location, partial perforations or a weakening line 29 may be provided. The capsule material also has sufficient impact and puncture strength such that impacts to the capsule (which may ordinarily occur when carrying the device) do not rupture the capsule 2 inadvertently. Various types of plastics are well known to those skilled in the art for such use.

In a particularly preferred embodiment, the capsule is comprised of two portions. A first inner portion 2′ is comprised of a suitable glass such as pyrex. The glass inner portion not only effectively retains the liquid skunk essence in the capsule 2 but also prevents permeation of the odors from the skunk essence when the protection device is not in use. Further, the glass inner portion 2′ is encased, for example, by coating, in a suitable material 2″ such as urethane. With this coating, the dispersion of glass fragments when breaking the inner portion 2′ is avoided. In other words, the urethane coating serves, to retain the glass fragments. However, the varathane or silicone or silica gel coating may be provided with the weakening line to aid in directing the skunk essence in the desired direction. The use of the plastic coating on the glass capsule further ensures the safety of the device to conform with consumer product safety standards.

In another embodiment of the present invention (FIG. 5), the support 31 is made substantially thicker than the support 1 of FIGS. 1–3. The support 31 includes a hollow cavity 33 therein which may be directly filled with skunk essence 3 and sealed in a suitable manner, for example, by laminating a sheet over the front surface of support 31. Alternatively, a capsule 35, filled with skunk essence 3, similar to the capsule 2 of FIGS. 1–3, may be secured in the cavity 35, for example, by gluing. The capsule 35 is preferably provided with partial perforations or a weakening line 37 to facilitate and control breakage of the capsule 35 when desired. By embedding the capsule 35 within the support 31, the risk of accidental breakage of the capsule is reduced.

Skunk essence is available commercially, and is typically sold as an animal lure. The skunk essence can either be used in pure form, or can be diluted up to about 50% by volume with a suitable diluent. A preferred diluent is mineral oil. Skunk essence is an effective repellant for animals and sharks as well as humans. Since it is an oily material, it can even be used in the water. It is preferred to include a dash of pepper with the skunk essence in the capsule since the pepper amplifies or magnifies the odor and effect of the skunk essence. Hunters and hikers will also find it useful to ward off attacks from animals such as bears, etc.

Skunk essence is retained two weeks to a month or longer unless neutralized by a suitable substance such as tomato juice. A mixture of tomato juice, baking soda, powdered milk and a little vinegar has been found to be particularly effective for neutralizing the odor of the skunk essence. At the same time, skunk essence is not harmful to skin or clothing and will not permanently harm the user nor the person or animal sprayed.

In order to reduce the chance that the user will point the device in the wrong direction, it is preferred that the rear surface 4 of support 1 be colored, e.g., green, and be rough or bumpy while the front surface 6 of support 1 is decorated and has a smooth surface.

Personal protection device 10 is activated by pushing the center of support 1 toward the target with the thumbs while gripping the edges of support 1 with the fingers. This bending action breaks capsule 2 along the perforation line 2*a* and sprays the skunk essence 3 onto the attacker. Support 1 prevents the skunk essence 3 from being sprayed in the direction of the user. The reaction of the human or animal attacker will be the same as if the attacker had been sprayed by a skunk, i.e., to retreat.

The device can either be carried as is, or can be attached to clothing or other articles as desired. In one embodiment illustrated in FIG. 2, support 1 is provided with a pressure sensitive adhesive 5 on the rear surface. To protect adhesive 5 until it is needed for attachment, removable backing layer 7 is provided. With this embodiment, backing layer 7 is removed to permit adhesive 5 to be employed to reversibly attach device 10 to any desired mounting surface, such as fabric or clothing. An additional advantage is that adhesive 5 helps to prevent device 10 from slipping out of the user's hands during an attack.

As discussed above, use of a rough or bumpy rear surface 4, which is color coded, allows the user to quickly determine that device 10 is pointed in the direction of the target. Making front surface 6 of support 1 smooth and decorated also allows the user to determine which way device 10 is aimed. Different decorations can be provided on front surface 6 for the pleasure of children and adults as desired.

The use of an adhesive layer for attachment to a mounting surface has been described above. In another preferred embodiment, device 10 is attached to another means of attachment, which means is then attached to clothing or other desired surface. Such means for attachment include clips and pins. An example of such an embodiment is illustrated in FIG. 4. In FIG. 4, a separate disk 12 having a pin 14 for attachment to fabric is employed as the means of attachment. In such an embodiment, disk 12 is smaller than support 1. Device 10 is reversibly attached to the disk by means such as pressure sensitive adhesive, mechanical connection, or VELCRO (trademark for synthetic materials which adhere when pressed together). Various such combinations will be readily apparent to those skilled in the art. By the combination of the smaller size of disk 12 and the reversible attachment, device 10 can be easily rapidly grasped in an emergency.

Another embodiment is to provide a hook for attachment of device 10 as a zipper pull. Various other means of attachment will be readily apparent to those skilled in the art.

Although the invention has been described in various preferred embodiments, one skilled in the art will appreciate that various modifications, substitutions, omissions, and changes may be made without departing from the spirit thereof. Accordingly, it is intended that the scope of the present invention be limited solely by the scope of the following claims.

What is claimed is:

1. A personal protection device comprising:

a flexible support having two sides including a first continuous back surface and a second outermost surface in atmospheric contact;

a capsule having an outer surface forming a portion of said outermost surface and opposite said back surface that is less flexible than the support, said outer surface being breakable upon flexural bending of the support, the entire surface of said capsule which forms a portion of said outermost surface being in direct contact with the atmosphere, said capsule having a mechanical bending strength less than said support such that bending of the support causes breakage of the capsule, said capsule containing a weakening line; and skunk essence within the capsule wherein upon flexure of said support the skunk essence is released in an amount sufficient to repel an attacker.

2. The device of claim 1 wherein the support is colored and roughened on the back side, and smooth and decorated on the front side.

3. The device of claim 1 wherein said support is flexible plastic.

4. The device of claim 1 further comprising means for reversibly attaching the support to a surface.

5. The device of claim 4 wherein the means for attaching is a pressure-sensitive adhesive.

6. The device of claim 4 wherein the means for attaching includes a pin.

7. The device of claim 4 wherein the means for attaching includes a disk attached to a pin, the disk having pressure-sensitive adhesive placed to allow attachment of the support to the disk.

8. The device of claim 1 wherein the capsule comprises a separate element secured to the front surface of the support.

9. The device of claim 1 wherein the support contains a cavity for receiving the capsule.

10. The device of claim 1, wherein the capsule is made of glass.

11. The device of claim 10, wherein the glass is surrounded by a urethane material.

12. The device of claim 11, wherein the urethane is provided with a centrally located weakening line.

13. A personal protection device comprising:

a support having front and back surfaces, said support being sufficient flexible to permit bending without breaking;

a capsule arranged at the front surface and secured to the support, said capsule having a mechanical bending strength less than said support such that bending of the support causes breakage of the capsule, said capsule comprising two portions, a first inner portion being glass and a second outer portion being urethane, the urethane retaining glass fragments upon breakage of the glass and being provided with a weakening line which is arranged centrally on the capsule for facilitating rupture of the urethane and for directing the skunk essence in the desired direction upon breakage of the glass; and skunk essence within the capsule.

14. A personal protection device comprising:

a flexible support having two sides including a first continuous back surface and a second outermost surface in atmospheric contact;

a capsule having an outer surface forming a portion of said outermost surface and opposite said back surface that is less flexible than the support, said outer surface being breakable upon flexural bending of the support, the entirely of said outer surface of said capsule which forms a portion of said outermost surface being in direct contact with the atmosphere, said capsule having a mechanical bending strength less than said support such that bending of the support causes breakage of the capsule, said capsule being made of glass and said glass being coated with a urethane material; and skunk essence within the capsule wherein upon flexure of said support the skunk essence is released in an amount sufficient to repel an attacker.

15. The device of claim 14, wherein the urethane coating is provided with a centrally located weakening line.

16. The device of claim 14 wherein the capsule contains a weakening line.

* * * * *